United States Patent [19]

Kuhtic et al.

[11] Patent Number: 4,986,549

[45] Date of Patent: Jan. 22, 1991

[54] TOSS GAME WITH TARGET COMPARTMENT AREAS

[76] Inventors: Charles E. Kuhtic, 201 River St., #12; John A. McSwieney, 201 River St., #46, both of, Troy, N.Y. 12180

[21] Appl. No.: 535,583

[22] Filed: Jun. 11, 1990

[51] Int. Cl.[5] ..... A63B 63/00; A63B 67/00

[52] U.S. Cl. ..... 273/402; 273/415

[58] Field of Search ..... 273/402, 415

[56] References Cited

U.S. PATENT DOCUMENTS

| | | | |
|---|---|---|---|
| 3,480,280 | 5/1967 | Gamertsfelder | 273/415 |
| 3,628,793 | 12/1971 | Mudloff | 273/415 X |
| 3,749,401 | 7/1973 | Hayko | 273/415 X |
| 4,203,592 | 5/1980 | Quatkemeyer | 273/336 |
| 4,726,591 | 2/1988 | Johnson | 273/402 X |
| 4,938,485 | 7/1990 | Hockridge et al. | 273/415 X |
| 4,943,065 | 7/1990 | DeLapa | 273/415 X |

*Primary Examiner*—William H. Grieb

*Attorney, Agent, or Firm*—Schmeiser, Morelle & Watts

[57] ABSTRACT

In a bag tossing game nesting target boards which form an enclosed compartment for the storage of tossing bags. Supports on the bottom side of the target boards support the target boards in an upright and angle position and provide buoyancy for use of the target boards in water. Ridges on the top surface of the target boards reduce the slippage of the tossing bags off of the target board surface during play.

5 Claims, 2 Drawing Sheets

TOSS GAME WITH TARGET COMPARTMENT AREAS

FIELD OF THE INVENTION

Generally, this invention relates to the field of games. More specifically, this invention is a bag toss game which utilizes two target boards. During storage, the target boards interlock forming an enclosed compartment between them for the storage of the tossing bags and any other items required.

BACKGROUND OF THE INVENTION

There appears to be an almost universal enjoyment by participants of tossing type games, be they formal games such as horse shoes, or something as simple as throwing a rock into the water then trying to land other rocks within the same area. Thus, the field of games is replete with different types of tossing games and new variations on this general concept are myriad. Occasionally, one such variation is able to combine the basic enjoyment of a tossing game with a new type of system or device which in some way either alters the play of the game, or improves the convenience of using the game to a point that the game becomes widely accepted.

For example, one well known game utilizes over sized darts which are weighted in order to stick in the ground when thrown, which darts are combined with two single ring targets with the play following somewhat similar to that of horse shoes. Two problems with this type of dart toss game are easily recognized. Namely, the obvious threat to safety and the difficulty of having to store the multiplicity of parts used in the game for future use.

Other games have combined this basic toss concept with yet other known games such as tic-tac-toe. In a game such as this, a bean bag or the like is often thrown onto a target and by any one of a variety of methods and an "x" or "o" designation is recorded where the bag has landed to come to rest. The goal of such games being similar to tic-tac-toe in that the user tries to align the same designations in a row until there is a connection made between one side of the target board and the other side. While such a game overcomes the safety threat posed by the dart toss game, the problem with storing the target and bags still remains.

Thus, virtually everyone having such a toss game has experienced the frustration of being unable to locate some of the parts of the game, the most common problem being a lack of a full compliment of toss items. Eventually, the toss items disappear and statements such as "you can only use three of yours because I can't find my fourth one" continue until the numbers eventually decrease to two or one. Any reduction in the number of toss items makes the game more difficult as the players must more frequently retrieve the toss items. Finally, the entire game is either left unused since "I can't find all the pieces" or the game is simply discarded.

To appreciate what the effect would be of having a toss game where one does not have to be worried about loosing the various parts, one need only consider the various games available at amusement centers or bazaars. Many of these include toss games such as the throwing of rings, balls or bean bags. Such games are very popular at these events, since they appeal to the natural tendency to play toss type games and also because the participant can use his or her skill in these tossing games without concern of the loss or gathering up of the various parts and pieces. Thus, it became evident to me that to have a tossing game which utilizes not only basic toss concepts but incorporates game variations as well as a simple yet effective storage mechanism, would not only provide a great deal of enjoyment but would also avoid much frustration.

In addition to the above stated factors many toss games are made for use in a specific setting. For example, some such games are solely for indoor use and are not constructed in a manner suitable for use out of doors. Or, alternatively, if the indoor game is used out of doors the various parts may become almost irreversibly soiled in which case the game becomes designated strictly as an outdoor game to avoid the use of these soiled items within the home. Still other games are seasonal or require a specific type of seasonal play surface. Summer time for example, lends itself to the use of games which are suitable for play as a water sport. However, such games might not be suitable for play outside of their aquatic environment.

Based upon a recognition of these problems and consideration of various solutions the applicants have developed the subject invention which combines basic toss concepts with a unique target combination. In addition, the subject invention solves the problem of storing the various toss items and the targets while providing versatile play pieces suitable for use not only indoors and outdoors but also as a water sport. Accordingly, applicant believes that the subject invention is a significant improvement over prior toss games and will obtain wide acceptance and provide much satisfaction and enjoyment to its users.

SUMMARY OF THE INVENTION

The subject matter of this invention is directed toward a new toss game having targets that engage each other for easy transportation of the target boards while also forming an enclosed storage compartment that acts as a receptacle for whatever type of tossing item used. The invention is blow molded out of plastic so as to form hollow supports which enable the toss game to float, and with rubber toss bags, it may be used as a water sport. When the boards are separated and used individually the variation in the support sizes will provide different buoyancies such that the boards will float on somewhat of an angle for easier viewing of the board and more simplified hand, eye coordination. When the target boards are engaged together back to back they still float, however, the different buoyancy of each target board support offsets the other providing a substantially horizontal game surface, more difficult distance evaluation and greater hand, eye coordination.

The subject invention accomplishes these purposes through the use of two target boards having a relatively flat top surface onto which the tossing bags may be thrown. Each target board has a hole through the center of the board that serves as a bulls eye and may be used in various ways during the play of the game. Concentric ridges on the top of the boards prevent the toss bags from sliding off of the targets. On the bottom of the boards are two sets of supports, one set of which is placed inward around the periphery of the hole in the middle of the game board, with the other set placed outwardly under and around the outer portion of the game board. The outer supports are higher toward one end of the board and lower toward the other end such that the boards are tilted when resting on the supports. For storage, the boards nest bottom to bottom with inner supports abuting each other, and the outer supports abuting such that the higher portions of the outer support abut the lower portions of the outer support of the opposing board. This creates a completely enclosed channel between the boards for storage of the tossing bags.

The target boards are blow molded of a plastic material in a manner which provides for the forming of hollow spaces within the supports. The amount of hollow space is sufficient to float the board in water. Since the outer support has different sizes with incomminently different amounts of air space, the larger portions which have greater air space will also be more buoyant thus raising that end of the target board so that the board remains angled even in the water. Alternatively, when used as a water sport the participants are not above the target as much as they are when the game is placed on the ground. This adds another dimension to the play as a type of hand, eye coordination is altered since the players are on a more similar plane with the target board and an overhand toss must be used. The target boards can be arranged to add an additional variation in that the boards may be nested back to back before being put in the water. The corresponding higher and lower portions of the outer supports cancel any variation in buoyancy so that the target floats substantially flat on the water. Thus, the players do not have a clear view of the target surface and therefore, the accurate tossing of the bags requires a greater exercise of depth perception and again a varied degree of hand/eye coordination. While the above is a summary of some of the characteristics and advantages of the subject invention man of the subtleties of the game such as the manner of play, ease of storage and versatility will only become truly evident and be fully appreciated through the actual use of the game.

DETAILED DESCRIPTION OF THE PREFERRED EMBODIMENT

Figure 1:
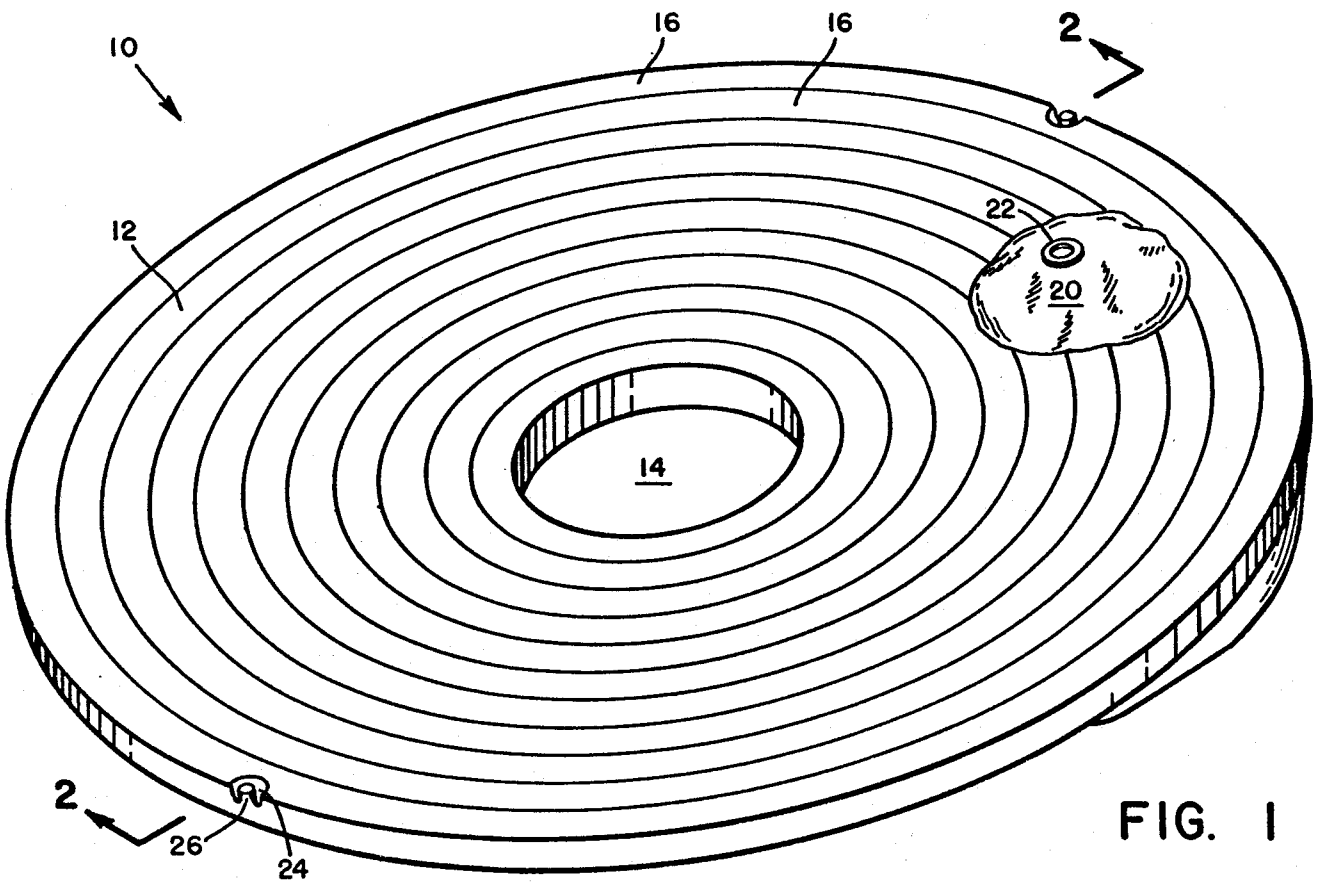
FIG. 1 is a perspective view of one of the target boards.

FIG. 1 shows a target board generally designated as 10 which has a top surface 12. Centrally located through the board is an opening 14 which serves as the board bulls eye. The top surface 12 of the target board 10 is divided into a plurality of concentric rings 16 which rings are separated from one and other by ridges 18 which raise slightly above the top surface. The ridges 18 in my preferred embodiment are approximately 1/32 to 1/64 of an inch high and help prevent the rubber tossing bags 20 from sliding over the top surface. The tossing bag 20 has a cap 22 for altering the contents of the bag. In my preferred embodiment the contents of the bag is a combination of water and menthol cellulose which combine to form a jelly-like filling. Depending on the proportions of water and menthol cellulose the consistency of the gel-like filling can be varied to obtain different bag characteristics. For scoring purposes a predetermined number of concentric rings 16 may make up a section having a predetermined value. If preferred, each concentric ring can have a designated value which increases as one moves closer toward the opening 14.

On opposite sides of the board are notches 24 each of which has a peg 26 which extends upwardly toward the top surface of the board. If desired, one of the notches 24 on each board can be narrower at their opening than the elastic band 38, thus, securing the band within the notch at all times to assure that the bands 38 are not misplaced during play.

Figure 2:
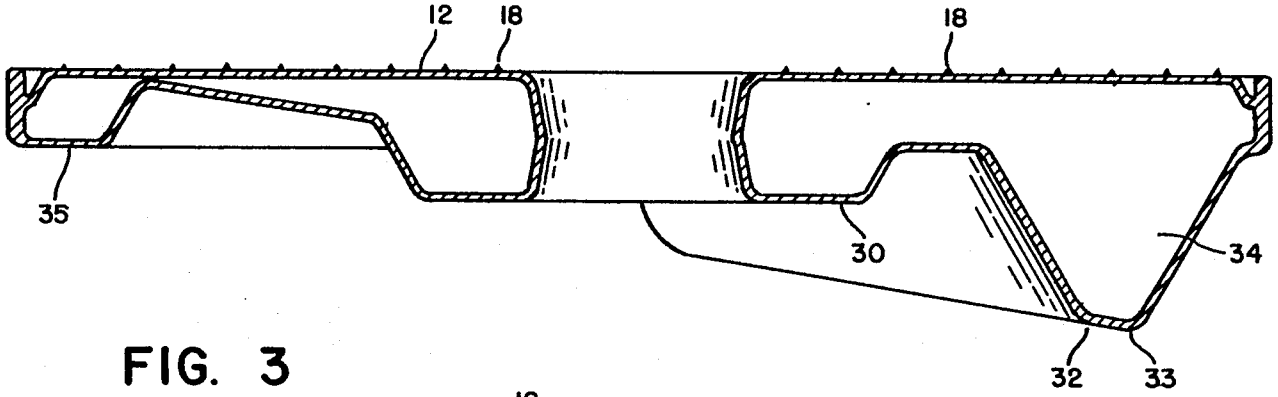
FIG. 2 is a cross sectional view taken along lines 2—2 of FIG. 1.

FIG. 2 is a side elevational view taken along lines 2—2 of FIG. 1 and showing the ridges 18 which in my preferred embodiment are approximately 1/32 to 1/64 of an inch above the top surface 12. The bottom surface 28 has an inner support ring 30 which is about the opening 14 and outer ring support 32 which extends around beneath the outer portion of the board when rested on a playing surface would be angled since outer support ring has a higher or larger portion 33 toward one side of the board and a smaller or lower portion 35 toward the other side of the board. The configuration of the outer support is essentially circular with the higher portion 33 extending 180° of the circle. When nested together the outer surface of the higher portion 33 of the first board abuts the inner surface of the lower portion 35 on the second board. Conversely, the outer surface of the higher portion 33 of the second board abuts the inner surface of the lower portion 35 of the first board. Also, the slopping portions of the outer supports on each board also engage each other. In the manner the nested boards are prevented from either slipping or rotating relative to each other. The slopping portions of the board are also beneficial when the board is used in the water. In this usage, the board when used separately floats at an angle and the sloped portions helps stabilize the board inhibiting rotation of the board in the water. In manufacture, the boards are blow molded such that the supports 30 and 32 are hollow as at 34 such that the entire target board is buoyant in water and floats at an angle similar to the angle created when the board is placed on a solid playing surface.

Figure 3:
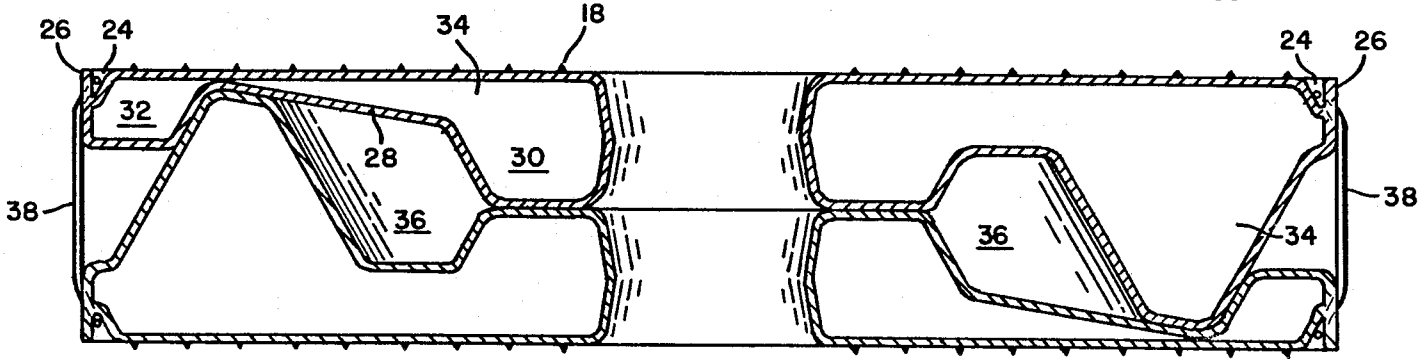
FIG. 3 is a cross sectional view similar to FIG. 2 but showing two target boards locked bottom to bottom in the nesting position.

When placed bottom to bottom the board's nest as shown in FIG. 3 with the larger portion of the outer support 32 nesting against the smaller portion of the outer support 32 of the other board. Similarly, the inner supports 30 abut each other thus forming a circular, totally enclosed storage compartment or sealed container 36 for holding the tossing bags 20. The enclosure of the compartment must be sufficient to prevent the tossing bags 20 from exiting the compartment irrespective of the positioning of the board during storage.

The target boards 10 are secured in this nesting position by means of elastic bands 38 which are secured over opposing pegs or stanchions 26 to secure the nested target boards 10 in the storage position. When used, the target boards 10 are disengaged by releasing the elastic bands 38 from their respective pegs 26. The boards are then separated approximately 25 feet and set on the supports 30 and 32 which results in the angling of the top surface of the board which boards are located to angle downwardly toward each other. The target boards in my preferred embodiment are 36 inches in diameter and the game includes eight tossing bags 20, four being of one color and the other four being of a different color. For scoring purposes the outer five concentric rings form a section which is given a one point designation. The remaining inner rings have a two point designation with the opening 14 having a three point score for tossing bags which overhang the hole or pass therethrough. Teams begin by alternately throwing the tossing bags 20 one at a time onto one of the target boards 10. The total points are added and the team scoring the most points receives credit for the difference between their score and the score of the other team. Play continues until one of the teams reaches a total score of 21 points. In an alternate approach the first team to direct one of the toss bags 20 through the opening 14 cancels all of the scores on the board and receives an additional three points.

If preferred the targo boards can be used in a pool with the target boards being used either separately so that they float at an angle or in their nesting position as shown in FIG. 3 which will cause the target board to float substantially flat in the water thus making the landing of a toss bag on the top surface 12 more difficult. Because the game can be used in the water the tossing bags in my preferred embodiment are made of rubber and as previously stated, the contents of the tossing bags can be varied so that they will float.

It should be appreciated that other methods of play are possible and that variations may be made without departing from the invention, the scope of which should only be limited by the appended claims.

We claim:

1. A bean bag type toss game with combined storage comprising:

a pair of nestable target boards each of said target boards having a top surface with a plurality of sections of predetermined value and a centrally located opening through the board, each board having a bottom surface and supports protruding outwardly from said bottom surface, said supports varying in size for angling the target board when placed in an upright position, said supports resting on a play surface and the top surface of the target board facing upwardly, said supports forming the boundary of a recess area on the bottom surface of each board, the bottom surfaces of said boards nesting with each other to nest together such that the boundary forming supports of each target abut each other creating an enclosed storage compartment for the storage of game pieces; and means for securing the boards together for storage.

2. The invention of claim 1 wherein the boards are circular and the top surface has a plurality of concentric ridges with a predetermined number of concentric ridges forming sections having predetermined values.

3. The invention of claim 2 further comprising stanchions on opposing parts of the top surface of each board; and the securing means being an elastic band securable to the stanchions on abutting boards for holding the boards against each other.

4. The invention of claim 3 further comprising a plurality of tossing bags, each bag having a cap therein for opening the bag and varying the contents of the bag according to the game conditions.

5. The invention of claim 1 wherein the target boards are buoyant and the supports extending downwardly from the bottom of the board stabilize the board in the water such that the board maintains an upright position and rotation of the board is inhibited.

* * * * *